US005730860A

United States Patent [19]

Irvine

[11] Patent Number: 5,730,860

[45] Date of Patent: Mar. 24, 1998

[54] PROCESS FOR DESULFURIZING GASOLINE AND HYDROCARBON FEEDSTOCKS

[75] Inventor: Robert L. Irvine, Overland Park, Kans.

[73] Assignee: The Pritchard Corporation, Overland Park, Kans.

[21] Appl. No.: 514,948

[22] Filed: Aug. 14, 1995

[51] Int. Cl.[6] ..... C10G 1/00

[52] U.S. Cl. ..... 208/213; 208/214; 208/251 H; 208/254 H; 208/305; 208/306; 208/310 R; 585/822; 585/826

[58] Field of Search ..... 208/210, 310, 208/213, 214, 251 H, 254, 306; 585/310 R, 822, 826

[56] References Cited

U.S. PATENT DOCUMENTS

| | | | |
|---|---|---|---|
| 3,767,563 | 10/1973 | Woodle | 208/85 |
| 4,775,484 | 10/1988 | Schmidt | 210/673 |
| 4,831,206 | 5/1989 | Zarchy | 585/737 |
| 4,831,207 | 5/1989 | O'Keefe | 585/737 |

OTHER PUBLICATIONS

Alcoa Industrial Chemicals Division, "Selexsorb CD", Jun. 1991, Product Data Sheet.

Natural Gas, "Natural Gas", A17, 93.

Alcoa Indusrial Chemicals Division, "Selexsorb Adsorbents", Brochure.

Alcoa Industrial Chemicals Division, "Alcoa Adsorbent Applications", Brochure.

Goodboy, K.P., et al., "Trends in Adsorption with Aluminas", *CEP*, 64–68, Nov. 1984.

Kirk, Othmer, et al., "Adsorption, Liquid Separation", Encyclopedia of Chemical Technology.

Irvine, Robert L., et al., "Converting Carbon Residue to Power and Hydrogen Needs", *Hydrocarbon Technology International*, 1994.

*Primary Examiner*—Helane Myers

*Attorney, Agent, or Firm*—Hovey, Williams, Timmons & Collins

[57] ABSTRACT

An apparatus and method for treating a liquid hydrocarbon stream useful as a precursor for transportation fuel and which contains an unacceptably high level of heteroatom compounds is provided for the removal of a significant portion of the heteroatom compounds from the hydrocarbon stream. The method and apparatus employ an adsorbent which is brought into countercurrent contact with a hydrocarbon stream in an adsorption zone to form a product hydrocarbon stream and a spent adsorbent stream. The adsorbent is recirculated to a desorption zone and is thereafter brought into cross-current contact with a reactivating medium, such as hydrocarbon gas, at elevated temperatures to form a reactivated adsorbent stream and a hydrogen/heteroatom stream. The regenerated adsorbent is recirculated back to the adsorption zone to form the adsorbent stream.

11 Claims, 3 Drawing Sheets

S--5a
182
140a
MAKEUP HYDROGEN BLEED
PRC
150
152
184
LLC
14
158
160
156
140b
S-5b
170
236
BULK LIQUID DISENGAGING VESSEL 140
258
188
DESORBER VESSEL 142
200
212
244
224
142a
142f
192
202
214
260
142g
238
246
226
142b
240
204
216
262
142h
248
228
142c
242
206
218
264
142d
250
230
142i
S-15
208
220
266
370
324
HEATER
243
142j
367
S-17
142m
252
232
142e
368
276
290
268
282
142k
FRC
369
302
278
296
142n
270
284
304
280
292
142o
272
286
306
281
142p
194
274
288
308
190
142l
136
134
128
132
400
OFF GAS
DESORBER OFFGAS SURGE VESSEL
372
393
COOLER
384
392
S-7
S-8
360
S-6
332
390
391
S-12
HT EXCHR 1
374
S-11
361b
330
389
S-9
HT EXCHR 2
S-10
361a
388
S-14
S-13
366
333
380
334
381
HT EXCHR 3
HT EXCHR 4
378
338
346
339
347
FRC
370
S-16
326
352
328
336
HEATER
HT EXCHR 5
354
344
365
371
S-19
345
363
364
S-20
362
357
S-21
358
359
320
312
S-18
144
314
318
HYDROGEN

PROCESS FOR DESULFURIZING GASOLINE AND HYDROCARBON FEEDSTOCKS

FIELD OF THE INVENTION

This invention generally relates to a method of treating liquid hydrocarbons, useful as precursors for transportation fuels. More particularly, the invention relates to a method for treating liquid hydrocarbon to remove heteroatom compounds, such as mercaptans, sulfides, thiophenes, benzothiophenes, amines, nitriles, or peroxides (gum precursors), which may be present in the liquid hydrocarbon at unacceptably high levels.

DESCRIPTION OF THE PRIOR ART

Recent legislation, in response to environmental concerns stemming from automotive air pollution, has been enacted to substantially lower the acceptable levels of sulfur present in the gasoline. Certain states have enacted regulations requiring transportation fuel producers to maintain less than 40 ppm sulfur in their gasoline by 1996. Other states are considering legislation which requires gasoline sulfur levels to be less than 150 ppm. These lower acceptable sulfur levels represent a substantial reduction over past acceptable sulfur levels.

The new and significantly lower acceptable sulfur levels in transportation fuel creates new problems for the processes currently used by the refining industry to remove sulfur from the gasoline product. Sulfur in both gasoline and diesel fuel has, in the past, been removed from fuel feedstocks to previously acceptable levels in several ways. The most common methods of sulfur removal from transportation fuels are distillate hydrotreating, Merox thiol extraction processing, and fixed bed adsorption (unsteady state). The available alternatives for producing gasoline with low sulfur content below 40 ppmw are extremely expensive.

In typical hydrotreating processes, a portion of the sulfur components are removed from a hydrocarbon feed stream by reaction of the sulfur components with hydrogen gas in the presence of a suitable catalyst to form hydrogen sulfide. Hydrogen sulfide is removed from the product gas stream by using a wash solvent (such as amine) followed by conversion of the hydrogen sulfide to elemental sulfur in a Claus plant. The hydrotreating process scheme usually involves mixing of a hydrocarbon feed stream with a hydrogen-rich gas (usually supplied from catalytic reforming processes) and thereafter heating and passing the hydrocarbon/gas mixture through a catalyst bed in a reactor. The reactor product is cooled and separated into a gas and liquid phase, and the off-gas containing hydrogen sulfide is discharged to the Claus plant for further processing. Hydrotreating processes that treat FCC gasoline, the major sulfur source in U.S. refinery gasoline, are characterized by both an undesirable, high rate of hydrogen consumption (due to olefin saturation) and a significant octane degradation.

Caustic extraction processes, such as Merox and Merichem, are capable of extracting sulfur from hydrocarbon which is in the form of mercaptan compounds. Mercaptans are corrosive compounds which must be extracted or converted to meet a copper strip test. The sodium mercaptan formed is soluble in caustic solution. The caustic containing the mercaptides is warmed and then oxidized with air with a catalyst in a mixer column which converts the mercaptides to disulfides. The disulfides are not soluble in the caustic and they can be separated from the caustic which is recycled for mercaptan extraction. The treated hydrocarbon is usually subject to a water wash in order to reduce the sodium content of the treated product.

The caustic extraction processes, however, are capable of extracting sulfur only in the form of mercaptan compounds which accounts for less than 10% of the sulfur present in a FCC gasoline, the major source of sulfur in gasoline product. Caustic extraction problems include: generation of hazardous liquid waste streams such as spent caustic (which is classified as hazardous waste); smelly gas streams which arise from the fouled air effluent resulting from the oxidation step; and the disposal of the disulfide stream. Further, Merox processing problems include difficulties associated with handling of a sodium and water contaminated product. Caustic extraction is able to remove only lighter boiling mercaptans while other sulfur components, such as sulfides and thiophenes, remain in the treated product streams. The oxygen compounds (e.g., phenols, carboxylic acids, peroxides) or nitrogen compounds (e.g., amines or nitriles) also found in FCC gasoline are not appreciably affected by Merox or Merichem caustic extraction processes.

Unsteady state/fixed bed adsorbers have also, in the past, been used as a means to remove a portion of pollutants when batch adsorption is permitted. The process scheme calls for a hydrocarbon stream containing a pollutant to be passed down through the relatively deep bed of adsorbent, which is initially free of the pollutant to be adsorbed. The top layer of adsorbent, in contact with the contaminated hydrocarbon entering the stream, is first to adsorb the pollutants. Eventually, the adsorbent will become progressively saturated with pollutant causing a breakthrough of the pollutant at the outlet of the adsorbent vessel from which a product stream is issuing. To prevent the contamination of the product stream, the pollutant-saturated adsorbent bed must be cycled off line and regenerated by raising the temperature of the adsorbent to a level causing a release of the pollutant from the adsorbent. The temperatures of the adsorbent, and the vessel containing the adsorbent, are raised usually by means of passing a hot gas reactivating medium through the adsorbent bed. This gas is also used as a carrier to transport the released pollutants from the adsorbent bed. Following regeneration, the adsorbent and vessel are cooled and cycled back on line. Problems arise, however, because the stream carrying the pollutants must be disposed of in an environmentally safe manner. The batch cycling process subjects the equipment, and the adsorbent, to cyclic heating and cooling, and thereby increases the quantity of reactivating medium required for the process. Furthermore, a significant portion of the adsorbent, when regenerated, under the batch process contains negligible heteroatoms. This portion corresponds to approximately half of the required for adsorption in the mass transfer zone associated with the batch processes.

In spite of the process limitations associated with hydrotreating, caustic extraction, and fixed bed adsorption, these processes have, for the most part, provided satisfactory means for reducing the level of pollutants present in refinery hydrocarbon transportation fuel feedstocks to levels which were previously acceptable. These processes are not, however, suited for the economic reduction of heteroatom pollutants in transportation fuel feedstocks to the new and substantially lower sulfur levels which are now or will soon be required by government regulations.

Accordingly, the process requirements to successfully remove heteroatom compounds from a hydrocarbon feed stream to trace quantities or to reduce sulfur content of gasoline to below 30 ppmw for refineries having heavy cokers or fluid catalytic crackers require attention. One of the most troublesome difficulties associated with the conventional adsorption processing in refineries having heavy cokers or fluid catalytic crackers is the availability of an adequate reactivating medium and the disposal of heteroatom compounds removed from the treated hydrocarbon streams.

SUMMARY OF THE INVENTION

The present invention overcomes the problems outlined above, and provides an apparatus and method useful in a process for removing heteroatom pollutants from gasoline and other liquid hydrocarbon feed streams. In accordance with the instant invention, a liquid hydrocarbon stream useful as a precursor for transportation fuel and which contains an unacceptably high level of heteroatom compounds, is treated to remove a significant portion of the heteroatom compounds from the hydrocarbon stream. The adsorbent reactivating medium employed is a hydrogen stream that is usually available in plentiful supply in most refineries. Using hydrogen makeup first as reactivating medium, and then as makeup to higher pressure hydroprocessing units (such as a diesel hydrotreater) eliminates the need to provide for expensive disposal of the desorbed heteroatoms since the desorbed materials, with its gas carrier stream, are simply directed to other refinery processing units which are not adversely affected by the heteroatom content of the gas stream. In the practice of the invention, the adsorbent reactivating medium may, however, also be made up of nitrogen gas or other hydrocarbon gases (such as methane, ethane, propane, butane or combinations thereof).

An adsorbent characterized by the property of adsorbing heteroatom compounds from a hydrocarbon stream is employed to provide an adsorption zone made up of at least two serially interconnected adsorption stages each having a lower inlet and an upper outlet, and presenting in the serial order an initial adsorption stage and a final adsorption stage. The adsorption stages are located in disposition and interconnected in a manner such that the outlet of each stage is connected to and communicates with the inlet of the next stage in the serial order thereof. The adsorbent stream is introduced into the adsorbent zone in the proximity of the final adsorbent stage outlet. The adsorbent stream is thereafter allowed to flow by gravity downwardly in serial order through the adsorbent stages, from the outlet of a respective stage to the inlet of the stage next adjacent thereto.

The hydrocarbon stream to be treated is introduced into the adsorbent zone initial stage inlet and thereafter is caused flow upwardly in serial order through the stages from the outlet of each of said stage to the inlet of the stage next adjacent thereto. The hydrocarbon stream is thereby brought into counter-current contact with the adsorbent stream in the adsorption zone for adsorption of a portion of the heteroatom compounds by the adsorption stream to produce a product hydrocarbon stream that exits the outlet of the final adsorption stage and a spent adsorbent stream that exits the adsorption stage in the proximity of the initial adsorption stage inlet. The upwardly flowing hydrocarbon liquid stream and the downwardly flowing adsorbent stream are maintained at about ambient temperature or as cold as economically practical when these streams are brought into countercurrent contact with one another. A higher concentration of adsorbent is permitted by equilibria considerations with a colder temperature.

A desorption section is provided with a regeneration zone and a cool-down zone. The regeneration zone is made up of a number of serially interconnected regeneration stages, each having an upper inlet and a lower outlet and presenting in the serial order, an initial regeneration stage and a final regeneration stage. Each regeneration stage is located in disposition and interconnected in a manner such that the outlet of each stage is connected to and communicates with the inlet of the next adjacent stage in the serial order thereof. The cool-down zone is also made up of a number of serially interconnected cool-down stages. Each cool-down stage has an upper inlet and a lower outlet and presents in the serial order thereof, an initial cool-down stage and a final cool-down stage. The cool-down stages are located in disposition and are interconnected in a manner such that the outlet of each cool-down stage is connected to and communicates with the inlet of the next adjacent cool-down stage in the serial order thereof. The regeneration zone and the cool-down zone are located in disposition and interconnected in a manner such that the outlet of the final regeneration stage is connected to and communicates with the inlet of the initial cool-down stage.

The spent adsorbent stream is introduced into the initial regeneration stage upper inlet to flow downwardly by gravity into respective inlets of the regeneration stages and the cool-down stages.

Heated hydrogen gas is introduced into the initial stage and into respective regeneration stages serially connected therewith. The heated hydrogen gas is brought into cross-current contact with the downward flowing spent adsorbent stream for the transfer of heat from the heated hydrogen stream to the downward flowing spent adsorbent stream. The heat transfer is sufficient to raise the temperature of the spent adsorbent stream to a level that causes the release of most of the heteroatom compounds from the spent adsorbent stream to form a hot regenerated adsorbent stream exiting the final regeneration stage outlet and a plurality of hydrogen and heteroatom gas streams exiting each regeneration stage in the regeneration zone.

The regeneration zone is operated such that hydrogen gas heats downwardly flowing spent adsorbent to a temperature of about 158° F. in the initial organic liquid vaporization stage, about 226° F. in the first regeneration stage, about 294° F. in the second regeneration stage, about 362° F. in the third regeneration stage, and about 518° F. in the fourth and final regeneration stage, causing the desorption of a proportion of heteroatoms adsorbed on the adsorbent. The cool-down zone is operated to maintain the exit temperature of the regenerated adsorbent at 105° F.

The apparatus of the invention is designed with a desorber vessel that provides sufficient residence time to continuously increase the temperature of the adsorbent entering the initial stages in the regeneration zone so that organic liquids clinging to the solid adsorbent particles will evaporate, as they are initially introduced to the desorber vessel, but before the adsorbent is heated to higher temperatures in later regeneration stages. Organics not containing heteroatoms are not generally as thermally stable as organics with heteroatom components, and thus must be removed from the adsorbent before the adsorbent is subjected to higher temperatures. Such unstable organic hydrocarbon liquids, particularly if unsaturated, could form carbonaceous deposits on the adsorbent if heated and exposed immediately to unduly high temperatures. The first three stages in the regeneration zone are thus operated at temperatures to provide for organic hydrocarbon liquid vaporization from the adsorbent before the adsorbent is subjected to in excess of about 300° F. Heteroatom desorption will also occur as the adsorbent passes through the first three stages of the regeneration zone at progressively higher rates (corresponding to equilibria conditions associated with the particular stage), with the gases leaving at stages. Conditions in three initial stages. Conditions in the next two stages, at progressively higher temperatures, complete the desired desorption of the heteroatoms.

The hot regenerated adsorbent stream is then introduced into the cool-down zone and flows downwardly by gravity in serial order through corresponding cool-down stages from the outlet of a respective stage to the inlet of the stage next adjacent thereto.

A stream of cool hydrogen gas is introduced into the initial cool-down stage and into respective cool-down stages serially connected therewith. This cool hydrogen gas is brought into cross-current contact with the downwardly flowing hot regenerated adsorbent stream for the transfer of heat from the hot adsorbent stream to the cool hydrogen gas stream. Heat transfer is sufficient to lower the temperature of the regenerated adsorbent stream to near ambient temperatures at which the adsorbent is capable of adsorbing heteroatom compounds. Thereafter, the cool adsorbent stream is recirculated to the adsorbent zone of the adsorber vessel and a hydrogen discharge stream is discharged from each said cool-down stage.

The instant invention further encompasses, as an alternative embodiment, the use of hydrogen gas streams as a adsorbent reactivating medium in association with an adsorbent processes which employ batch, rather than continuous, concurrent flow, processing.

DETAILED DESCRIPTION OF THE PREFERRED EMBODIMENTS

Figure 1A:
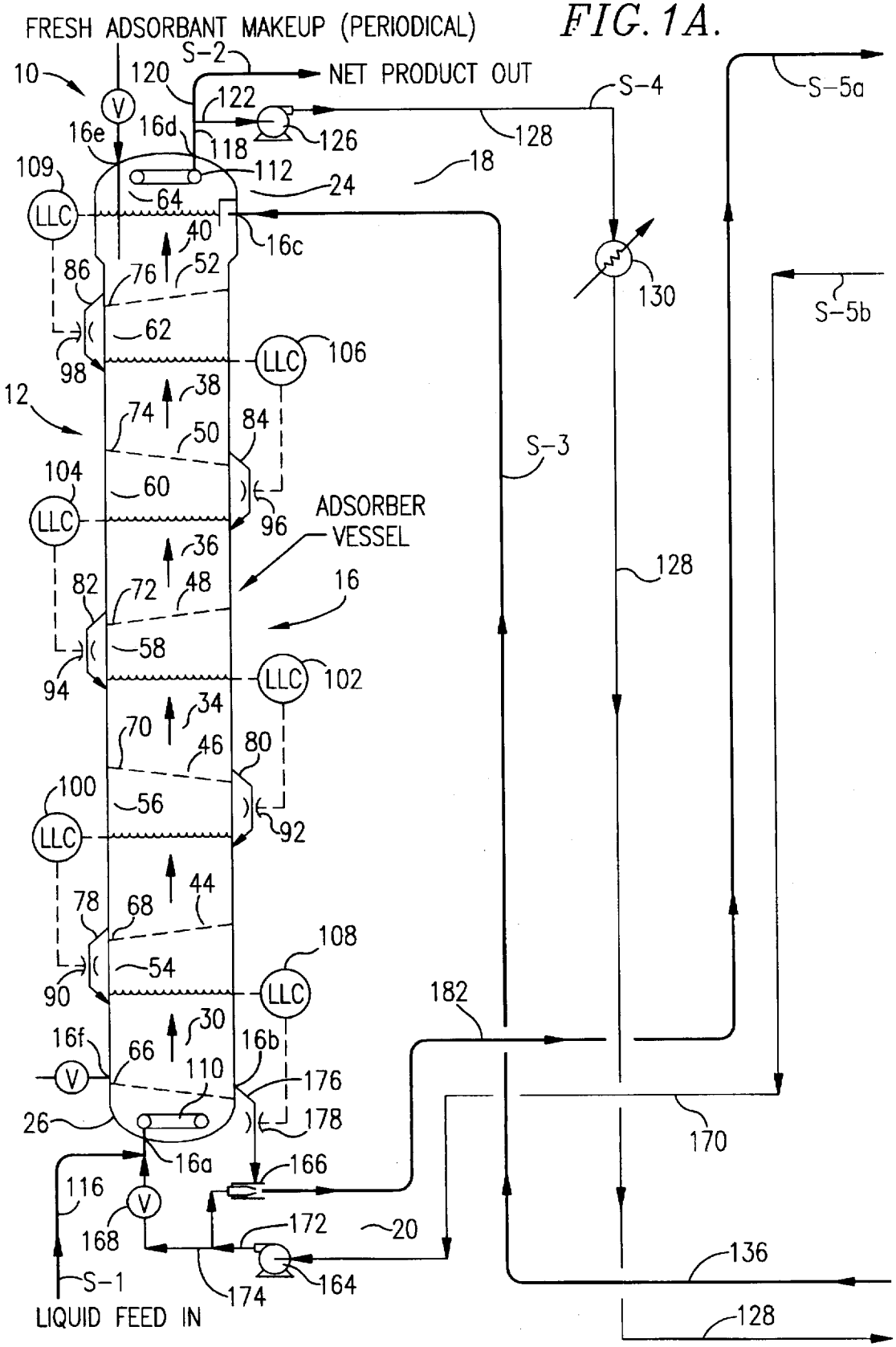
FIGS. 1A and 1B are schematic diagrams of the apparatus used for the process of removing heteroatoms from gasoline and hydrocarbon feedstocks that typically serve as precursors for transportation fuel.
Figure 1B:
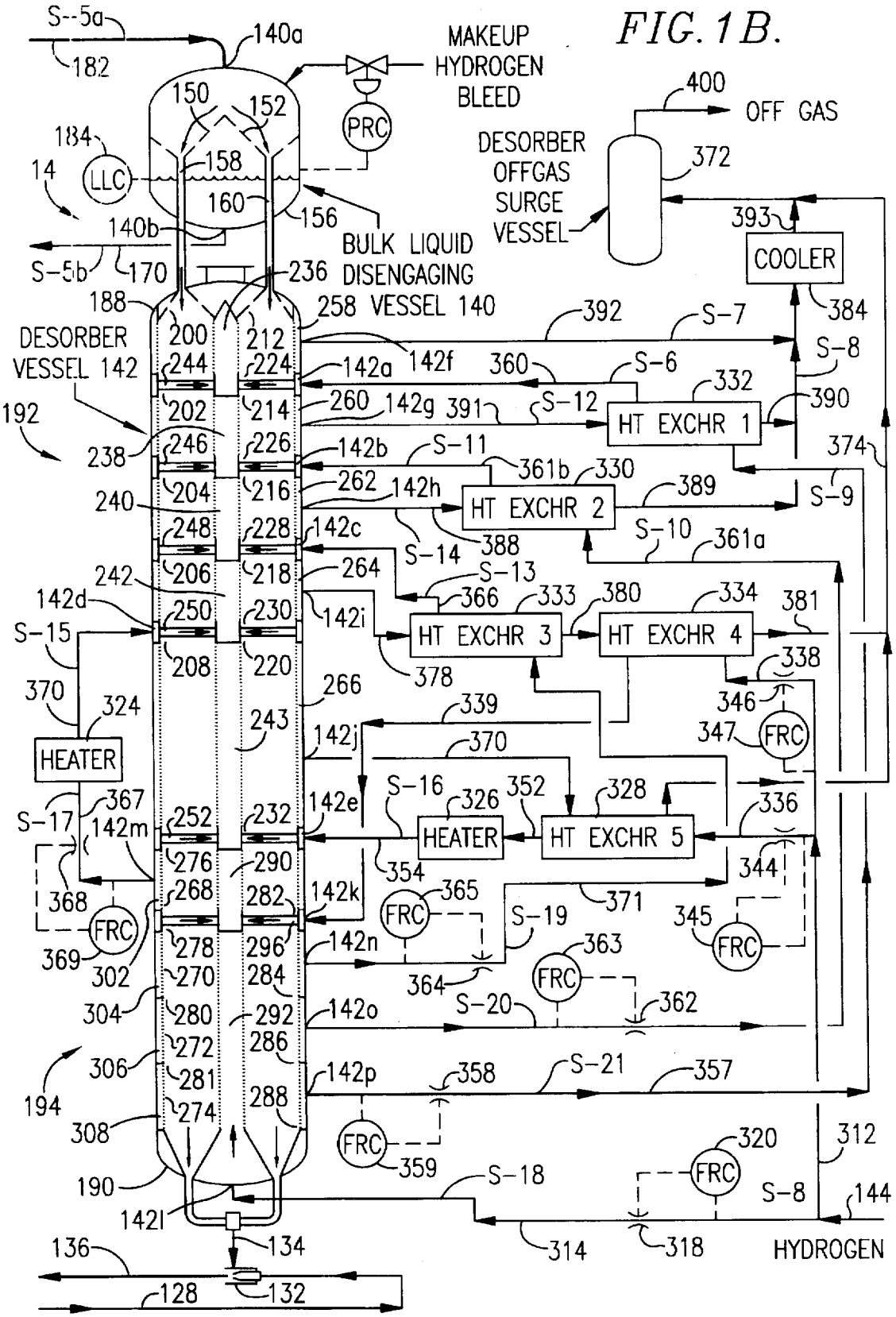

The apparatus broadly designated 10 in FIGS. 1A and 1B permits economical desulfurization of hydrocarbon liquids, including FCC (fluidized catalytic cracking) to FBR (full boiling range) naphtha intermediates produced in FCC unsaturated gas plants as precursors for transportation fuels. Apparatus 10 is particularly suited for desulfurization of FCC naphtha intermediates which account for approximately 80% of sulfur content in the current U.S. gasoline pool. Average FCC gasoline sulfur approximates 756 ppm based upon a survey of U.S. refinery gasolines in 1990. FCC gasoline typically accounts for 36 vol % of the U.S. gasoline. For most refineries, a low sulfur content for the FCC gasoline product is a must if low sulfur gasoline is required.

At present, the available alternatives for producing low sulfur content gasoline are extremely expensive, as previously discussed. The illustrative example that follows shows that the process and apparatus of the invention provides an economic solution to the problem of reducing sulfur and other heteroatoms to very low levels in gasoline (e.g., 40 ppmw). Total heteroatom removal from the FCC gasoline to levels below 40 ppmw would meet No. 1 copper strip specification because the corrosive elements are sufficiently removed.

In the illustrative example, typical sulfur distribution in a full boiling range FCC gasoline stream fed apparatus 10 may be considered as follows:

| Heteroatoms (Sulfur) | Weight Fraction |
|---|---|
| Mercaptans-Sulfur | .0320 |
| Sulfide-Sulfur | .0096 |
| Tetrahydrathiophene | .0179 |
| Thiophene | .0640 |
| $C_1$ Thiophenes | .1522 |
| $C_2$ Thiophenes | .1727 |
| $C_3$ Thiophenes | .1202 |
| $C_4$ Thiophenes | .1164 |
| Benzothiophene | .3150 |
| TOTAL | 1.0000 |

Apparatus 10 is also useful for the economical removal of other nitrogen and oxygen compounds which may also be present as pollutants in other hydrocarbon feed streams, such as FCC-FBR naphtha and intermediates. (The sulfur, oxygen, and nitrogen-containing compounds present as pollutants in the hydrocarbon are hereinafter referred to as "heteroatoms".)

Turning now to the structure of the invention, apparatus 10 is made up of two basic units. Those units include an adsorber section 12 and a desorber section 14. Referring initially to FIG. 1A, the adsorber section 12 includes an adsorber vessel 16, a fresh adsorbent recirculation header 18 and a spent adsorber recirculation header 20. Adsorber vessel 16 is made up of an upright vessel shell 22 having a top head 24 and bottom head 26. Within the vessel shell 22 is an adsorption zone 28 which includes an initial adsorption stage and a final adsorption stage. In the preferred embodiment, the adsorption zone 28 has six adsorption stages designated as a first adsorption stage 30, a second adsorption stage 32, a third adsorption stage 34, a fourth adsorption stage 36, a fifth adsorption stage 38, and a sixth adsorption stage 40. Adsorption stages 30–40 are serially interconnected as shown in FIG. 1A. Each of the adsorption stages 30–40 have lower inlets 42, 44, 46, 48, 50 and 52 and upper outlets 54, 56, 58, 60, 62 and 64. Each of the adsorption stages 30–40 respectively function as serially interconnected, upright fluidized beds. Further, it is to be understood that during normal operation of adsorber section 12, the column defined by adsorption stages 30–40 is completely filled with flowing liquid hydrocarbon plus fluidized beds of adsorbent particles.

The adsorbent in each stage may be a particulate adsorbent, such as Alcoa "Selexsorb" adsorbent obtainable from Alcoa Industrial Chemicals, Bidalia, Louisiana, or other suitable adsorbent capable of adsorbing polar pollutants, in the form of heteroatoms, from hydrocarbon liquids. Useful adsorbent particle size may range may range from 0.4 to 1.6 mm, but a closely screened, smaller size within 15 mesh, such as 40 to 50 U.S. mesh, is preferred.

Lower inlets 42–52 are defined by flow distributors 66, 68, 70, 72, 74 and 76 which serve to support particulate adsorbent within each of the stages 30–40 inclusive. Suitable stage distributors in this respect include a Johnson-type screen or porous plate with openings small enough to retain the adsorbent particles when flow is interrupted.

Inter-stage adsorbent transfer lines 78, 80, 82, 84 and 86 permit the downward flow of adsorbent containing a level of heteroatoms in successive increased concentrations from the sixth adsorption stage 40 in serial order to the initial contact stage from which the spent adsorbent with the highest concentration of heteroatoms is withdrawn. Each intermediate transfer line 78–86 includes a level control valve 90, 92, 94, 96 and 98 which regulates adsorbent flow through lines 78–86 to control the level of adsorbent in each stage by means of liquid level controllers 100, 102, 104, 106 and 108, as shown schematically in FIG. 1A.

Flow distributors 66–76 slope slightly downwardly toward transfer lines 78–86 to aid the gravity flow of adsorbent downwardly from one adsorption stage to the next adsorption stage.

The adsorber vessel bottom head 26 is provided with hydrocarbon feed inlet 16*a* which directs the flow of incoming hydrocarbon feed to feed distributor ring 110. Adsorber vessel 16 is also provided with a spent adsorber outlet 16*b*, a regenerated adsorbent inlet 16*c*, a treated hydrocarbon product outlet 16*d*, and a fresh adsorber makeup inlet 16*e*, all schematically shown in FIG. 1A. Treated hydrocarbon product exits the adsorber vessel 16 through product outlet 16*d*.

Hydrocarbon feed requiring treatment by apparatus 10 is introduced into adsorber vessel inlet 16*a* through line 116. Treated hydrocarbon product exits from adsorber outlet 16*d* through line 118 which splits into lines 120 and 122. Line 120 delivers hydrocarbon product from adsorber vessel 16 to a point of use. Line 122 delivers hydrocarbon with low heteroatom content to the fresh adsorbent recycle header 18 for slurry transport.

The fresh adsorbent recycle header 18 includes a rump 126 which receives recycled hydrocarbon from line 122 at its suction inlet and discharges the recycled hydrocarbon product as a fluid carrier via line 128 to cooling water heat exchanger 130, and thence to the carrier fluid inlet of fresh adsorbent eductor 132, as shown in FIG. 1B. Regenerated adsorbent is supplied to the suction inlet of eductor 132 from the desorber section 14 via line 134. The mixture of regenerated adsorbent and hydrocarbon liquid exiting the discharge opening of eductor 132 is supplied to fresh adsorber inlet 16*c* of the adsorber vessel 16 through line 136, as shown in FIG. 1A.

The adsorber vessel has a 73'6" overall tangent to tangent height with about 54'6" of expanded bed adsorbent solids in the various stages. Vessel diameter is 8'0", except for the enlarged section in the uppermost stage which is about 9'6" in diameter. The diameter for the adsorber vessel reflects the comparatively large mass of fluid per unit time being treated.

Adsorption in the liquid phase is slower than in the gas phase. The higher adsorbent inventory in the adsorber than in the desorber offsets this factor.

Desorber section 14 includes a bulk liquid disengaging vessel 140, a desorber vessel 142, a hydrogen supply header 144, and hydrogen heat exchange system 146.

Bulk liquid disengaging vessel 140 includes a pair of funnel-shaped screen separators 150 and 152 disposed within the liquid disengaging vessel 140 to receive the spent adsorbent and the hydrocarbon carrier fluid through upper inlet 140*a* from the spent adsorber recycle header 20. Separators 150, 152 serve to collect and support the spent adsorbent for a sufficient period of time during its downward travel through disengaging vessel 140 to allow the hydrocarbon carrier fluid to drain therefrom through the separators 150, 152 into a liquid collection portion 156 of disengaging vessel 140, as shown schematically in FIG. 1B. Drained, spent adsorbent passes from separators 150, 152 into the desorption vessel 142 via lines 158 and 160. Collected hydrocarbon carrier liquid passes from disengaging vessel 140 to the spent adsorbent recirculation header 20 via outlet 140*b*, as schematically shown in FIG. 1B.

The spent adsorbent recirculation header 20 includes a pump 164, eductor 166, bulk liquid disengaging vessel level control valve 168 and associated piping. Carrier hydrocarbon liquid is supplied from disengaging vessel 140 through line 170 to the suction of pump 164. Carrier hydrocarbon fluid is discharged from pump 164 to the liquid inlet of eductor 166 through line 172. Excess hydrocarbon liquid exits from line 172 through level control valve 168 to line 116 which directs the liquid hydrocarbon to line 116 to enter as feed to stage 30 through inlet 16*a*. Spent adsorbent is supplied from adsorber vessel 16 through outlet 16*b* to the eductor 166 inlet suction through line 176. The adsorbent level in first adsorption stage 30 of adsorber vessel 16 is maintained preferably by varying speed of pump 164 which is operated by LLC 108 that senses the column height of adsorbent in first adsorbent stage 30, as schematically shown in FIG. 1A. The mixture of spent adsorbent and liquid carrier exiting the discharge of eductor 166 is supplied to the bulk liquid disengaging vessel 140 through inlet 140*a* via line 182. LLC 184 controls the return of excess liquid through valve 168 to maintain the operating level of carrier hydrocarbon liquid in the bulk liquid disengaging vessel 140.

Desorber vessel 142 is an upright vessel having an upper head 188 and a lower head 190. The desorber vessel 142 further includes a preheat and regeneration zone 192 and a cool-down zone 194. The regeneration zone 192 is made up of a number of serially interconnected regeneration stages. The preferred embodiment includes five stages designated as an organic vaporization stage 200, a first regeneration stage 202, second regeneration stage 204, third regeneration stage 206, and fourth regeneration stage 208. Each regeneration stage is located in disposition and interconnected in a manner such that the outlet of each regeneration stage is connected to and communicates with the inlet of the next adjacent regeneration stage in the serial order thereof. Stages 200–208 have upper inlets 212, 214, 216, 218, and 220, and lower outlets 224, 226, 228, 230 and 232, respectively. Each stage 200–208 includes upright, centrally located, essentially cylindrical hydrogen distribution plenums 236, 238, 240, 242 and 243, to which hot hydrogen gas is supplied via lines 244, 246, 248, 250 and 252 from hydrogen inlets 142*a*, 142*b*, 142*c*, 142*d* and 142*e*, respectively, as shown in FIG. 1B. Each stage 200–208 includes hydrogen collection plenums 258, 260, 262, 264 and 266, the inner walls of which are cylindrical, Johnson-type screens, or porous plate streams with openings small enough to retain adsorbent particles but large enough to permit the passage of hydrogen gas. The outer walls of collection plenums 258–266 are defined by the cylindrical wall of vessel 142 adjacent the respective plenums. Hydrogen gas exits hydrogen collection plenums 258–266 via outlets 142*f*, 142*g*, 142*h*, 142*i* and 142*j*.

The desorber cool-down zone 194 includes a number of serially interconnected cool-down stages presenting in serial order an initial cool-down stage and a final cool-down stage. Each cool-down stage is located in disposition and interconnected in a manner such that the outlet of each cool-down stage is connected to and communicates with the inlet of the next adjacent cool-down stage in the serial order thereof. The cool-down zone 194 is located in disposition and interconnected with the regeneration zone within the disengaging vessel 140 in a manner such that the outlet of the final regeneration stage is connected to and communicates with the inlet of the initial cool-down stage. In the preferred embodiment, the cool-down zone 194 is made up of four cool-down stages designated as first cool-down stage 268, second cool-down stage 270, third cool-down stage 272, and fourth cool-down stage 274, each of which includes solids inlets 276, 278, 280 and 281, and solids outlets 282, 284, 286 and 288, respectively. Hydrogen gas is supplied to the first cool-down stage 268 through hydrogen distribution plenum 290 via line 296 through inlet 142*k* and to the second, third and fourth cool-down stages 270–274 through hydrogen distribution plenum 292 from inlet 1421. Hydrogen gas exits the cool-down stages 268–274 via plenums 302–308 through outlets 142*m*, 142*n*, 1420 and 142*p*. The inner walls of plenums 302–308 comprise cylindrically-shaped, Johnson-type screens or perforated or porous plate material with openings small enough to prevent entry of the adsorbent solids but large enough to permit the flow of hydrogen gas. The outer walls of hydrogen collection plenums 302–308 are defined by the vessel 142 wall portions adjacent the respective plenum.

Figure 2:
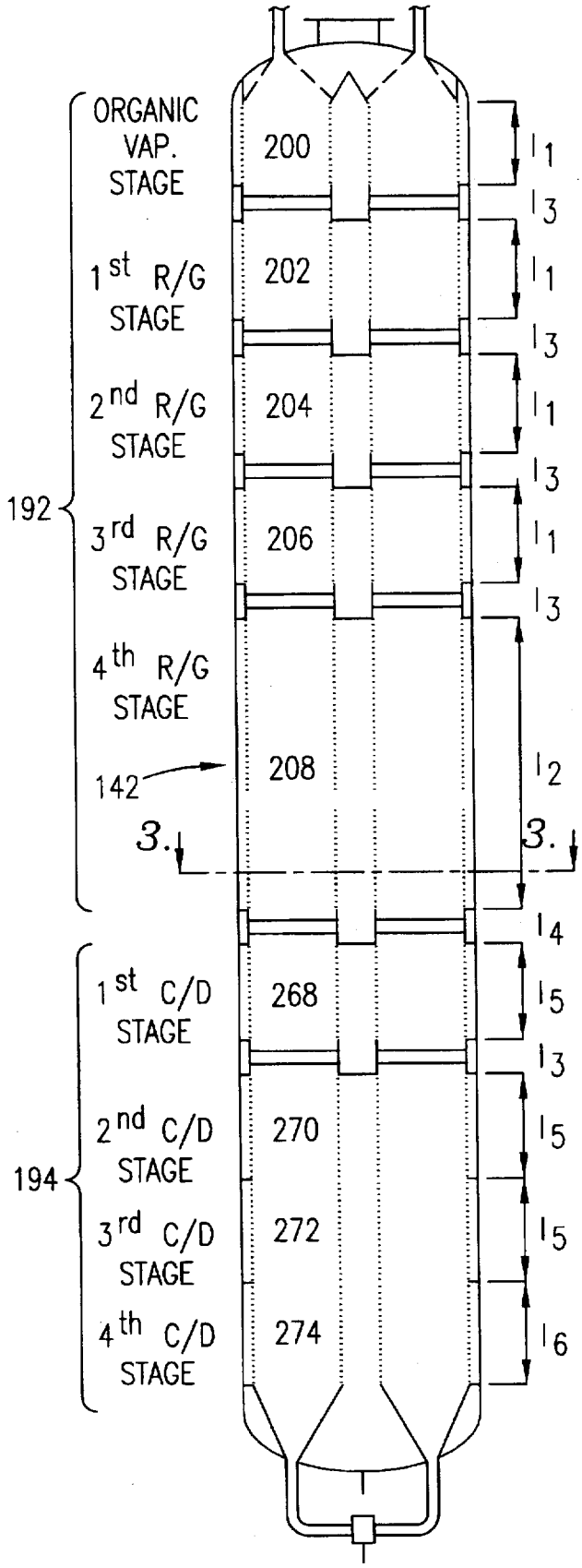
FIG. 2 is a schematic side view of a portion of the desorber vessel.

Turning now to FIG. 2, stages 200, 202, 204 and 206, in the preferred embodiment, each have approximately 7.5' of screened radial flow active height (designated as $l_1$). The fourth regeneration stage 208 has approximately 25.66' of active screened radial flow height (designated as $l_2$). There is about 12" of unscreened distance between stages 220, 202, 204 and 206 (designated as $l_3$), and about 16" of unscreened vertical distance between the fourth regeneration stage 208 and the first cool-down stage 268 (designated as $l_4$). The overall height of desorber vessel 142 is about 94' (allowing about 14" of length above the bottom tangent for solids collection).

Figure 3:
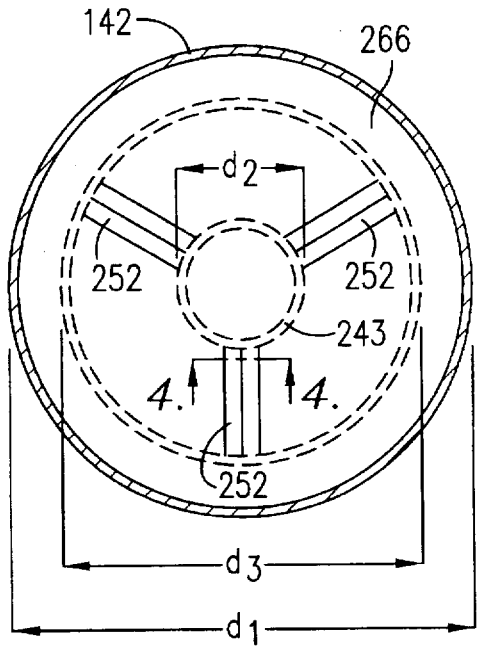
FIG. 3 is a schematic diagram showing a desorber vessel regeneration stage in cross-section.

FIG. 3 shows a schematic cross-section of a typical regeneration stage. In the example, the desorber vessel 142 has a diameter $d_1$ of 36", a hydrogen inlet plenum diameter $d_2$ of 12", and an outlet plenum inner wall diameter $d_3$ of 32.75".

Figure 4:
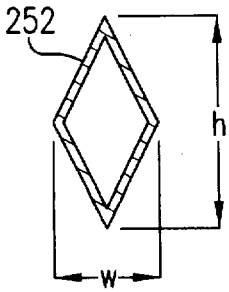
FIG. 4 is a schematic diagram showing a cross-sectional view of the shape of piping used to admit hydrogen gas into the hydrogen distribution plenum of the desorber vessel.

FIG. 4 shows a cross-section of a typical hydrogen gas inlet pipe, such as lines 244, 246, 248, 250 and 296, with a height h of 12" and width w of 6". Line 252 has a height h of 16" and a width w of 6". The diamond-shaped, cross-sectional shape of the pipe creates a smaller cross-section for the downwardly plug flow of the adsorbent without generating any appreciable pressure drop in the adsorbent as it passes between stages. This configuration provides sufficient confinement so that the estimated operating temperatures referenced below are reasonably achieved.

Hydrogen supply header 144 supplies hydrogen gas to the hydrogen heat exchange system 146 via line 312, and to desorber vessel hydrogen inlet 142*l* via line 314. The control of hydrogen gas flowing to the inlet 142*l* of the desorber vessel 142 is controlled by means of control valve 318 which is operated by flow regulator controller 320.

The hydrogen heat exchange system 146 includes heaters 324 and 326, and heat exchangers 328, 330, 332, 333 and 334 and associated piping and flow control valves. Hydrogen gas at ambient temperature is supplied from line 314 to inlet 142*l*, and to the inlet of heat exchanger 328 via line 336 and to heat exchanger 334 via line 338 where it is heated and supplied via line 339 to the first cool-down stage 268 via inlet 142*k*. Flow regulating control valve 344 and regulator 345 and control valve 346 and regulator 347 control the flow of hydrogen gas through lines 336 and 338, respectively. Hydrogen gas that is heated in heat exchanger 328 passes to heater 326 via line 352 where it is again heated in heater 326 and is supplied to vessel inlet 142*e* via line 354. Hydrogen gas exiting the fourth cool-down stage 274 via outlet 142*p* is supplied to heat exchanger 332 via line 357 and flow is controlled by means of flow regulating valve 358 and regulator 359. In heat exchanger 332, hydrogen gas is heated and supplied to inlet 142*a* of organic vaporization stage 200 via line 360. Hydrogen gas exiting the third cool-down stage 272 via outlet 142*o* is supplied to heat exchanger 330 via line 361*a* and flow is controlled by means of flow regulating valve 362 and regulator 363. In heat exchanger 330, the hydrogen gas is heated and thereafter supplied to the first regeneration stage 202 through inlet 142*b* via line 361*b*. Hydrogen gas exiting the second cool-down stage 270 through outlet 142*n* is supplied to heat exchanger 333 via line 371 which includes flow regulating control valve 364 and flow regulator 365. After exiting heat exchanger 333, hydrogen gas is supplied to the second regeneration stage 204 through inlet 142*c* via line 366. Hydrogen gas exiting the first cool-down stage 268 through outlet 142*m* via line 367 and flow control valve 368 and flow regulator 369 is supplied to heater 324 where the hydrogen gas is heated and supplied to third regeneration stage 206 through line 370 via inlet 142*d*. Hydrogen gas exiting the fourth regeneration stage 208 through outlet 142*j* is supplied to heat exchanger 328 via line 370 where it is cooled and thereafter supplied to a desorber off-gas surge vessel 372 via line 374. Hydrogen gas exiting the third regeneration stage 206 through outlet 142*i* is supplied to heat exchanger 333 via line 378 where it is cooled and thereafter supplied to heat exchanger 334 via line 380. Thereafter, it is again cooled and directed via line 381 into line 374 where it is thereafter supplied to surge vessel 372. Hydrogen gas exiting the second regeneration stage 204 via outlet 142*h* is supplied through line 388 to heat exchanger 330. Thereafter, hydrogen gas is directed via line 389 to cooler 384. Hydrogen gas exiting the first regeneration stage 202 through outlet 142*g* is supplied through line 391 to supply hydrogen gas to heat exchanger 332 where it is cooled and supplied to cooler 384 via line 390, which joins line 389. Hydrogen gas is discharged from organic vaporization stage 200 through outlet 142*f* and is supplied to line 392 which joins with line 389 to supply hydrogen gas to cooler 384. Hydrogen gas exiting cooler 384 is supplied to line 374 via line 393 where it is directed to surge vessel 372.

The off-gas from surge vessel may be employed as hydrogen makeup to higher pressure hydrogenation processes in the industrial unit or to hydrogen makeup compressor via line 400.

Illustrative Example

The operation of the invention will now be described in detail. For a better understanding of the operation of apparatus 10, specific parameters are referenced hereunder and set forth a representative material balance for the illustrative example that may be advantageously carried out in accordance with the present invention to remove heteroatom compounds from full boiling range FCC gasoline feed. It is to be understood in this respect that the specific parameters are for exemplary purposes only and represent relative values based on arbitrary values selected for illustration purpose and are not intended to define the parameters of a specific plant to be deemed a limitation on the process.

The material balance illustrates typical conditions that may be employed to produce a full boiling range FCC gasoline product stream which contains less than 30 ppm heteroatoms on the basis of 1000 barrels/hr (corresponding to 263,300 lbs/hr) hydrocarbon feed into the adsorber vessel 12.

In the example presented below, the FCC gasoline feed stream contains heteroatoms in the following concentrations:

TABLE 1

| Heteroatoms | Feed In (wppm) |
|---|---|
| Nitrogen | 16.0 |
| Oxygen | 14.0 |
| Mercaptan sulfur | 24.2 |
| Sulfide sulfur | 7.3 |
| Thiophene sulfur | 13.5 |
| Thiophene sulfur | 48.4 |
| $C_1$ thiophene sulfur | 115.0 |
| $C_2$ thiophene sulfur | 130.6 |
| $C_3$ thiophene sulfur | 90.9 |
| $C_4$ thiophene sulfur | 88.0 |
| Benzothiophene sulfur | 238.1 |
| Total | 786.0 |

For convenience, the principal streams of the illustrative process that are set out in the schematic representations of FIGS. 1A and 1B are keyed to the parameters referenced herein. In the description hereof, streams are identified as "S-n" wherein "S" represents "stream" and "n" is the number assigned to that stream.

The fresh feed introduced into apparatus 10 via line 116 and identified as stream S-1. The example consists of a full boiling range FCC gasoline available from an FCC unsaturated gas plant.

The hydrocarbon feed stream S-1 is cooled by cooling water in a conventional process to a temperature of 90° F. and stream S-1 is introduced (at a pressure of 230 psig) into the bottom of adsorber vessel 16 through inlet 16*a* and is distributed within the bottom head 26 by means of feed distribution ring 110. Thereafter the hydrocarbon stream flows upwardly into the initial and first adsorption stage 30, and thereafter flows upwardly in serial order through the second through sixth adsorption stages 32–40, from the outlet of each stage to the inlet of the stage next adjacent thereto. After reaching the top head 24 of adsorber vessel 16, the treated hydrocarbon stream is collected and exits adsorber vessel 16 through outlet 16*d* flowing into line 118 as hydrocarbon product stream desirably having less than 30 ppm heteroatom content, at 90° F. with a pressure of about 200 psig. Thereafter, the net hydrocarbon product stream is split and a portion is supplied to the fresh adsorbent recirculation header 18 through line 122, and the balance of the hydrocarbon product stream is supplied as stream S-2 through line 120 to any desirable point of use, including transportation fuel storage facilities.

Referring now to stream S-3, regenerated adsorbent from the desorber section 14 is transported by a carrier hydrocarbon liquid stream to the top portion of adsorber vessel 16 through inlet 16*c*. Once within adsorber vessel 16, the fresh adsorbent enters the final and sixth adsorption stage 40 and thereafter flows downwardly in serial order through the fifth, fourth, third, second, and first adsorption stages, from the outlet of a respective stage to the inlet of the stage next adjacent thereto. The adsorbent stream passes downwardly between stages via lines 86, 84, 82, 80, and 78 and in doing so passing from the final adsorption stage to the initial adsorption stage. The gravity flow of adsorbent between stages is assisted by the incline of flow distributors 68–76. Adsorbent exits from the first adsorption stage 30 in the proximity of its lower inlet 42 through outlet 16*b* and is directed via line 176 to eductor suction 166. The level of adsorbent in the first adsorbent stage 30 is maintained by level controller 180 which causes level control valve 178 to open or close as needed for level control. The adsorbent level in the second through sixth adsorption stages 32–40 is maintained by level controllers 100–108 opening or closing level control valves 90–98 as needed to maintain the proper adsorbent level within the stages 30–40.

As fresh adsorbent gravity flows from the sixth stage 40 downwardly through the first stage 30, it comes into countercurrent contact with upward flowing liquid hydrocarbon from stream S-1, adsorbing in incremental amounts in each stage heteroatom compounds present in the hydrocarbon stream. In adsorber vessel 16, the upwardly flowing liquid hydrocarbon from stream S-1, under normal design conditions, is such that the adsorbent bed expansion in each adsorbent stage 30–40 is between 8% to 16% of the volume occupied by the adsorbent in each stage absent the upward flow of hydrocarbon liquid. Maintaining the bed expansion within this range establishes some countercurrent flow within a fluidized stage that improves the adsorption plug flow character of the stage with local circulatory movement of the entering adsorbent particles flowing countercurrent to the rising liquid until the adsorbent is transferred to a lower stage or withdrawn from the final stage of the adsorber.

The spent adsorbent from line 176 is directed to the suction inlet of eductor 166 where it is mixed with hydrocarbon carrier fluid supplied from pump 164 to the carrier fluid inlet of the eductor 166. The carrier hydrocarbon fluid is pumped by pump 164 at a sufficient rate to transport the adsorbent in stream S-5*a* to the inlet 140*a* of bulk liquid disengaging vessel 140. Stream S-5*a* enters the disengagement vessel at a pressure compatible with the desired pressure being maintained in the desorber vessel 140. For example, a pressure of about 200 psig is maintained at the top of the adsorber but other reasonable pressures may be employed which maintain a liquid phase and which are compatible with the hydrogen (or other reactivating medium) pressure available and the desorber operating pressure. The flow rate of carrier fluid to eductor 166 is varied to be consistent with the addition of fresh adsorbent in stream S-3 to the top of adsorber vessel 16 to maintain a constant solids-fluid interface in the first adsorption stage 30 of the adsorber vessel 16.

Table 2 below presents the constituents of the solid feed in stream S-5*a* which enters the adsorber vessel 142.

TABLE 2

| Solid Feed Entering Desorber | lb/H |
|---|---|
| Absorbent (organic free) | 37152 |
| Absorbent heteroatoms | 203 |
| Absorbent organic portion of heteroatom components | 609 |
| Adhering liquid to be evaporated | 380 |
| Total | 38344 |

After entering the bulk liquid disengaging vessel 140, stream S-5*a* encounters separators 150–152 which allow the liquid hydrocarbon to drain from stream S-5*a* into the liquid collection portion 156 of vessel 140, whereupon the drained adsorbent is directed into desorber vessel 142 via lines 158 and 160. Hydrocarbon liquid collected in the liquid collection portion 156 of vessel 140 exits through outlet 140*b* and is thereafter directed as stream S-5*b* to the suction side of pump 164 via line 170. In this manner, a portion of the liquid hydrocarbon feed stream S-1 may be used effectively in the spent adsorbent recirculation header 20 as a compatible carrier fluid for the spent adsorbent transfer from the adsorber vessel 16 to the desorber vessel 142. Hydrocarbon liquid in excess of that required for the operation of the spent adsorbent recirculation header 20 is directed through valve 168 via line 174 into adsorber vessel 16.

Disengaging vessel 140 is provided with adequate surge volume for solids inventory level while at the same time providing adequate solids flow into the desorber vessel 142, as described hereafter.

After bulk liquid-phase disengagement in vessel 142, the adsorbent stream is preheated in the organic vaporization stage 200, which is the initial stage of the regeneration zone 192 and acts as the first phase for removal by evaporation of any liquid phase that remains on the solid adsorbent. A portion of the less polar/adhering heteroatom contaminants from the adsorbent stream will also desorb in stage 200, depending upon equilibria conditions of the gas stream and the temperature of the adsorbent. Thereafter, the spent adsorbent flows serially downwardly into respective solids inlets 212, 214, 216, 218 and 220 of stages 200–208, after which the adsorbent enters cool-down zone 194.

While passing downwardly through the regeneration zone 192, the spent adsorbent is brought into cross-current contact with hot hydrogen adsorbent regeneration gas (acting as the reactivating medium). In the organic vaporization stage 200, hot hydrogen gas stream S-6 is introduced through inlet 142*a* and hydrogen distribution plenum 236 at a rate of 7834 lbs/hr and at 201° F. and about 201 psig. The hot hydrogen gas comes into cross-current contact with downwardly flowing adsorbent causing the adsorbent temperature to increase to a temperature as indicated in Table 5. The released heteroatoms and hydrocarbons are carried by the hydrogen gas to the hydrogen collection plenum 258, whereupon the stream exits through outlet 142*f* and is discharged into line 392 as stream S-7. Stream S-7 will typically have a temperature of about 142.6° F. Use of the stream S-6, which is a warmer effluent resulting from the cooling of hydrogen stream S-12 and the warming of hydrogen stream S-21 released from the lowermost cool-down stage 274, provides a heat transfer medium sufficient to accomplish the necessary evaporation and desorption of adsorbed materials, and thus reduces hydrogen makeup required and increases the thermal efficiency of apparatus 10.

The adsorbent continues thereafter from the organic vaporization stage 200 to the first regeneration stage 202 where it is brought into cross-current contact with hydrogen at about 269° F. supplied from hydrogen distribution plenum 238 via supply line 246 through inlet 142*b* from line 361*b* carrying stream S-11 at a rate of 7826 lbs/hr hydrogen. In the first regeneration stage 202, the hydrogen gas further raises the temperature of the adsorbent (see Table 5) and causes the release of about 16 lbs/hr heteroatoms, 43 lbs/hr organic heteroatom portion, and 137 lbs/hr liquid evaporated hydrocarbon which is carried by the hydrogen gas to the hydrogen collection plenum 260 and thereafter exits through outlet 142*g* in the form of stream S-12 flowing through line 391. Stream S-12 may be at a temperature of about 210.6° F., and will, in the illustration provided, contain 196 lbs/hr desorbed heteroatom compounds and evaporated hydrocarbon.

From the first regeneration stage 202, the adsorbent continues its flow downwardly to second regeneration stage 204 where it comes into cross-current contact with hydrogen from hydrogen distribution plenum 240, with hydrogen being supplied via line 248 from inlet 142*c* and line 366 forms stream S-13. The hydrogen stream S-13 flows at a rate of 7839 lbs/hr and may, for example, be at a temperature of 337° F. The hydrogen gas in cross-current flow contact with the adsorbent causes the adsorbent temperature to increase (see Table 5), causing the release of about 34 lbs/hr heteroatoms, 95 lbs/hr organic heteroatom portion, and 167 lbs/hr liquid evaporated hydrocarbon from the downwardly-passing adsorbent.

Thereafter, heteroatom compounds and evaporated hydrocarbon are released and carried by the hydrogen gas into the hydrogen collection plenum 262 and exit through outlet 142*h* into line 388 in the form of stream S-14. Stream S-14 will be about 278.6° F.

From the second regeneration stage 204, the adsorbent continues its downward flow into the third regeneration stage 206 where it is once again brought into cross-current contact with hot hydrogen gas flowing from hydrogen distribution plenum 242, with hot hydrogen gas being supplied via line 250 from inlet 142*d* and line 370 that supplies hydrogen stream S-15 at 7643 lbs/hr at about 405° F. In the third regeneration stage 206, the hydrogen gas raises the temperature of the adsorbent (see Table 5) to cause the release of about 57 lbs/hr heteroatoms, 165 lbs/hr organic heteroatom portion, and 8 lbs/lb evaporated liquid hydrocarbon, which is thereafter carried by the hydrogen gas to the hydrogen collection plenum 264.

The adsorbent continues its downward flow from the third regeneration stage 206 into the fourth regeneration stage 208 where it is again brought into cross-current contact with hot hydrogen gas flowing from the hydrogen distribution plenum 243, with hot hydrogen gas being supplied via line 252 from inlet 142*e* and line 354 that supplies hydrogen gas stream S-16 at a rate of 24920 lbs/hr, 520° F. In the fourth regeneration stage 208, hydrogen gas raises the temperature of the adsorbent (see Table 5) to cause the release of 57 lbs/hr heteroatoms, and 288 lbs/hr organic heteroatom portion, with the 377 lbs/hr released heteroatoms compounds being carried with the hydrogen gas to the hydrogen collection plenum 266.

Table 3 below summarizes the gas desorption heat transfer duties for each stage in the regeneration zone 192.

TABLE 3

| | Gas Desorption Duties (MM BTU/H) | | | | |
|---|---|---|---|---|---|
| | Organic Vaporization Stage | 1st Regen. Stage | 2nd Regen. Stage | 3rd Regen. Stage | 4th Regen. Stage |
| Solid sensible heat | .6063 | .6063 | .6063 | .6063 | 1.3910 |
| Retained heteroatom and liquid sensible heat | .0045 | .0037 | .0021 | .0016 | |
| Heteroatoms component desorption | .0045 | .0106 | .0232 | .0400 | .0679 |
| Liquid evaporation | .0086 | .0173 | .0021 | .0010 | |
| Total | .6239 | .6379 | .6526 | .6489 | 1.4589 |

Table 4 below presents the estimated desorption occurring in stages 200–208.

TABLE 4

Estimated Desorption Occurring in The Desorber Vessel

| | Calculated Gas Effluent, °F. | Hetero-atoms, lb/H | Organic Portion, lb/H | Liquid Evaporated, lb/H | Total Desorbed Leaving lb/H |
|---|---|---|---|---|---|
| Organic Vaporization Stage | 142.6 | 7 | 18 | 68 | 93 |
| 1st Regen. Stage | 210.6 | 16 | 43 | 137 | 196 |
| 2nd Regen. Stage | 278.6 | 34 | 95 | 167 | 296 |
| 3rd Regen. Stage | 346.6 | 57 | 165 | 8 | 230 |
| 4th Regen. Stage | 481.0 | 89 | 288 | — | 377 |

In Table 5, desorber vessel 142 calculated average temperatures are presented.

TABLE 5

Desorber Zone Calculated Average Temperatures

| | Solid Adsorbent | | Gas | | |
|---|---|---|---|---|---|
| | In °F. | Out °F. | In °F. | Out °F. | Remarks |
| Organic Vaporization Stage | 90.0 | 158.0 | 201.0 | 142.6 | |
| 1st Regen. Stage | 158.0 | 226.0 | 269.0 | 210.6 | |
| 2nd Regen. Stage | 226.0 | 294.0 | 337.0 | 278.6 | |
| 3rd Regen. Stage | 294.0 | 362.0 | 405.0 | 346.6 | |
| 4th Regen. Stage | 362.0 | 518.0 | 520.0 | 481.0 | |
| 1st Cool-down Stage | 518.0 | 332.0 | 218.4 | 371.3 | same as gas flowrate to 3rd Regeneration Stage |
| 2nd Cool-down Stage | 332.0 | 181.0 | 90.0 | 216.8 | same as gas flowrate to 2nd Regeneration Stage |
| 3rd Cool-down Stage | 181.0 | 124.6 | 90.0 | 139.0 | same as gas flowrate to 1st Regeneration Stage |
| 4th Cool-down Stage | 124.6 | 103.2 | 90.0 | 108.3 | same as gas flowrate to Organic Vaporization Stage |

Table 6 below presents calculated heater duties for desorber vessel 142.

TABLE 6

Calculated Heater Duties for Desorber

| | MM BTU/H |
|---|---|
| 3rd Regen. Stage Feed Heater 324 | .3759 |
| 4th Regen. Stage Feed Heater 326 | 1.7761 |
| Total | 2.1520 |

The heater duties are comparatively small for the feed quantity being treated. Ample heat available at the required temperature normally should be available in the heavy cycle oil and slurry bottoms pump-arounds at the FCC unit supplying the feed stream to be treated. Heat exchange from these streams may therefore supply the required heater duties required for desorption. Presented in Table 7 below are desorber vessel 142 gas outlet cooling duties.

TABLE 7

Illustrative Example Desorber Gas Outlet Cooling Required

| | Duty MM BTU/H |
|---|---|
| Organic Vaporization Stage, 142.6 → 100 °F. | .4467 |
| 1st Regeneration Stage, 118.2 → 100 °F. | .1895 |
| 2nd Regeneration Stage, 149.2 → 100 °F. | .5169 |
| Total | 1.1531 |

Note that the third and fourth regeneration stages 206–208 are cooled by hydrogen supply heat exchange to 99.6° F.

The trim cooling duty for cooling the regenerated adsorbent at about 105° F. leaving the desorber vessel 142 mixes with hydrocarbon carrier in the stream S-4 to form a hydrocarbon carrier/regenerated adsorbent stream at 88° F. which enters the uppermost stage of the adsorber vessel 16. This duty corresponds to only 0.1510 MM BTU/H. The foregoing indicates the comparatively low utility requirements for the process of the invention considering that 24000 BPSD of FCC full boiling range gasoline is being processed with nearly complete removal of all heteroatoms in the above example. As FCC gasoline is the major contributor of sulfur to the U.S. gasoline now being consumed, the process of invention could contribute towards reducing the polluting $SO_x$ and $NO_x$ emissions from automobile engines in the U.S. Light coker naphtha, which usually has a significantly higher sulfur content, but is usually less than 5% by volume of the FCC full boiling range gasoline, could be processed concurrently in the same unit along with the FCC feed to further reduce the sulfur content of gasoline produced by U.S. refineries.

The adsorbent continues its downward flow from the fourth regeneration stage 208 into the initial and first cool-down stage 268 where it comes into cross-current flow relationship with hydrogen gas at 218.4° F. supplied from line 339 through inlet **142*k* and line 296 via hydrogen distribution plenum 290 causing the adsorbent temperature to drop (see Table 5). Thereafter, the hydrogen gas, now at 371.3° F., exits the first cool-down stage 268 through hydrogen collection plenum 302 and outlet 142*m* to become stream S-17 flowing through line 367**. Stream S-17 flows at a rate of 7643 lbs/hr.

The adsorbent flowing downward from the first cool-down stage 268 enters the second cool-down stage 270 where it comes into cross-current contact with 90° F. hydrogen flowing from stream S-18 through line 314 and from inlet **142*l* into inlet plenum 292, causing the adsorbent further to cool down (see Table 5). The hydrogen heated in the second cool-down stage 270 flows through hydrogen collection plenums 304, through outlet 142*n*, where it becomes S-19 at 216° F. The adsorbent continues to flow downwardly from the second cool-down stage 270 into the third cool-down stage 272 where it comes again into cross-current contact with hydrogen gas flowing from inlet plenum 292 after which the hydrogen gas cools the downwardly flowing adsorbent. The heated hydrogen gas flows to the hydrogen collection plenum 306 and exits through outlet 142***o* into line 361 where it becomes stream S-20 at 139° F. The cooled adsorbent exits the third cool-down stage 272 and flows downwardly into the fourth cool-down stage 274 where it again comes into cross-current contact with hydrogen gas flowing from inlet plenum 292, after which the hydrogen gas cools the downwardly flowing adsorbent. The heated hydrogen gas flows to collection plenum 308 and exits through outlet 142*p* into line 357 where it becomes stream S-21 at about 105° F.

The cooled adsorbent exits the fourth cool-down stage 274 and lower head 190 of the desorber vessel 142 at a rate of 37,152 lbs/hr, and enters the suction of eductor 132 associated with the fresh adsorbent recirculation header 18. Fresh adsorbent mixes with hydrocarbon fluid carrier supplied from pump 126 through line 128 to the carrier fluid inlet of eductor 132. The mixture of fresh adsorbent and carrier fluid discharged from the eductor 132 outlet becomes stream S-3 which flows through line 136 returning to the upper head 24 of adsorber vessel 16, and particularly into the sixth adsorption stage 40.

The flow of slurry in the discharge of eductor 132 normally controls the flow rate of stream S-3 into the sixth stage 40 of adsorber vessel 16. The flow rate of the slurry in stream S-3, in practice, is varied as necessary to maintain the desired heteroatom content in the net product stream S-2 exiting adsorber vessel 16 and may be adjusted by varying the carrier fluid recycle rate entering eductor 132 at the base of desorber vessel 140. The carrier fluid recycle rate may be varied by altering the output of recycle pump 126.

Benefits of Hydrogen Gas as Desorbent and Heat Exchange Medium

Hydrogen gas is available economically as a reactivating medium from the usual hydrogen makeup from hydroprocessing units producing diesel and higher boiling feed streams in refineries is supplied to the desorber vessel 142 to serve both as a desorbent and as a heat transfer medium. Hydrogen provides a desirable desorption gas medium for the adsorbent because it has a relatively high rate of defusivity into the adsorbent. Further, hydrogen tends to prevent the fouling of the adsorbent during the high temperature desorption step because hydrogen is reducing in nature. With respect to heat transfer, hydrogen has a high thermoconductivity when compared to other gasses that might be used as a heat transfer medium. Thus, hydrogen gas is very effective as an agent for heating the adsorbent to effect release of heteroatom compounds, as well as for cooling the adsorbent to near ambient temperatures for recirculation to the adsorber vessel.

Table 8 below presents the catalytic reformer hydrogen supply used in the example.

TABLE 8

Constituents of Catalytic Reformer Hydrogen Gas Supply

| Constituents | Mol Fraction | MW | Weight Fraction |
|---|---|---|---|
| Hydrogen | .8600 | 2.016 | .2972 |
| Methane | .0685 | 16.043 | .1884 |
| Ethane | .0346 | 30.069 | .1783 |
| Propane | .0218 | 44.097 | .1647 |
| Butanes | .0098 | 58.122 | .0977 |

TABLE 8-continued

Constituents of Catalytic Reformer Hydrogen Gas Supply

| Constituents | Mol Fraction | MW | Weight Fraction |
|---|---|---|---|
| Pentanes | .0030 | 72.149 | .0370 |
| Cyclopentane plus | .0023 | 93.18 | .0367 |
| | 1.0000 | 5.834 | 1.0000 |

The constituents expressed above may vary with severity, octane quality, catalyst state, reformer feed and operating pressure of the reformer reactors.

It will be appreciated, however, that other gas may serve as reactivating mediums in the practice of the invention, including nitrogen and hydrocarbon gases such as methane, ethane, propane and butane. The gas selected need only be compatible with the process streams as described above and be available in plentiful supply.

The following tables illustrate the estimated performance of the invention as employed for the illustrative example. Table 9 contrasts the heteroatom content of the hydrocarbon feed stream with the heteroatom content in the product stream effluent (stream S-2 in the example discussed above).

TABLE 9

| | Heteroatoms, wppm | | Heteroatom Organic Portion | | |
|---|---|---|---|---|---|
| | Feed In S-1 | Net Product Out - S-2 | Weight Ratio Applic-able | Feed wppm | Net Product wppm |
| Nitrogen | 16.0 | 0.1 | 2.93 | 46.9 | .3 |
| Oxygen | 14.0 | 0.1 | 2.69 | 37.7 | .3 |
| Mercaptan sulfur | 24.2 | 0.1 | 1.38 | 33.4 | .1 |
| Sulfide sulfur | 7.3 | 0.1 | 1.81 | 13.2 | .2 |
| Thiophene sulfur | 13.5 | 0.2 | 1.75 | 23.6 | .4 |
| Thiophene sulfur | 48.4 | 0.5 | 1.63 | 78.9 | .8 |
| $C_1$ thiophene sulfur | 115.0 | 1.7 | 2.06 | 236.9 | 3.5 |
| $C_2$ thiophene sulfur | 130.6 | 2.4 | 2.50 | 326.5 | 6.0 |
| $C_3$ thiophene sulfur | 90.9 | 1.9 | 2.94 | 267.2 | 5.6 |
| $C_4$ thiophene sulfur | 88.0 | 2.1 | 3.38 | 297.4 | 7.1 |
| Benzothiophene sulfur | 238.1 | 7.1 | 4.00 | 952.4 | 28.4 |
| Total | 786.0 | 16.3 | | 2314.1 | 52.7 |

The sulfur content for the full boiling range FCC gasoline feed used in the illustrative example assumes the average sulfur content found for U.S. refineries after surveying to establish the reference for reformulated gasoline base properties, The net product out (stream S-2) heteroatom content is estimated to correspond to that after the equivalent of 100 regenerations. The instant invention provides sufficient flexibility to continuously provide a treated product stream under 30 ppm heteroatoms after allowing for further degradation of the adsorbent (as more than 1200 regenerations are probable).

The example is illustrative in that it shows how a normally difficult feedstock may be economically treated for the removal of heteroatoms, and provides an economical solution for the gasoline sulfur required in California in 1996.

The Benefits of the Desorber Vessel

In desorber vessel, stages 200–208, acting as heating stages, together with the four cool-down stages 268–274, enables efficient heat recovery from the first, second, third and fourth regeneration stages 202–208 and also provides for sufficient heat transfer to hydrogen gas stream S-21 discharged from the fourth cooldown stage 274. In this way, stream S-21, after leaving heat exchanger 332, is heated to about 201° F. in stream S-6 permitting the evaporation of the adhering liquid organic hydrocarbon on the adsorbent solid stream entering vessel 142, as well as providing sufficient temperature rise in the adsorbent to release the weakly adhering hydrocarbon in the pores of the adsorbent without causing any appreciable polymerization of unsaturated hydrocarbons, such as olefins, that are present on the adsorbent. Such polymerization and associated subsequent coking on the adsorbent particles is thus avoided.

Adsorbent Attrition

In the practice of the instant invention, adsorbent attrition should be negligible in the slurried streams of S-3 and S-5 because of the cushioning effect of the hydrocarbon organic fluid during transport. Further, as a result of operation of the transport lines and the adsorber vessel at near ambient temperatures, these components can be inexpensively coated with a suitable cushioning plastic, Attrition of adsorbent particles or erosion of pipe or walled surfaces in the slurried transport lines S-3 and S-5 or in the adsorber vessel 16 is also negligible when operating in the design velocity range identified above.

Required long term performance is maintained by withdrawing part of the circulating regenerated absorbent and replacing with fresh absorbent makeup. Long term fresh adsorbent makeup is expected to be of the order of 0.02 to 0.06 pounds per barrel of feed being treated.

Other Feed Streams

The process of invention may also be used to treat other unsaturated feed streams, including C3 to C5 olefin feed streams to alkylation processing. Contaminants may be removed from olefin feed streams to etherification processing (such as for MTBE or TAME) according to the method of the instant invention with the added advantage of reducing any acetonitrile or propronitrile continuously to less than 0.2 ppm. Heteroatoms may also be removed from an olefin feed stream prior to introduction to a diene hydrogenation conversion processing. Sulfur and nitrogen adversely affect the performance and life of precious metal catalysts generally used to saturate acetylenes and dienes to olefins resulting in increased onstream time. Pyrolysis feedstocks visbreaking and coker derived feedstocks are examples of other unsaturated feedstocks that may be successfully treated. Similarly, the entire liquid overhead of a crude distillation unit with approximately a 500° F. (260° C.) endpoint can be similarly treated by the process of the invention. In this way, individual treatment of each of the product streams (propane, butanes, light straight run, naphtha, catalytic reformer feedstock, and aviation turbine kerosene) may be avoided.

Lighter liquid hydrocarbon fractions, saturated or unsaturated, such as C3 feed streams, C4 feed streams and C5 to 250° normal boiling point feed streams contain components which, because of their ready adsorption characteristics, are economically treated using the process and apparatus of the invention to lower the total heteroatom content of the treated product to below 0.5 ppmw. Heteroatom removal includes being able to remove more than 99% of lower boiling inorganics, such as ammonia, carbonyl sulfide, or hydrogen sulfide, that may be present in the feed. In contrast, conventional caustic treating typically only removes mercaptans to below 5 ppm and does not affect the other impurities (e.g., ammonia, carbonyl sulfide, and nitriles).

Saturated liquid feedstocks may be similarly treated with the process of the invention for the reduction of heteroatoms to required levels. For example, reduction of the sulfur and nitrogen continuously below 0.2 ppm is achievable with the invention when treating light straight naphtha to prepare feeds for C5/C6 isomerization or higher boiling naphtha feedstocks used to prepare feeds for catalytic reforming. It is also possible to remove heteroatoms from kerosene or jet fuel by employing the instant invention to furnish a continuously dry product, free of gum precursor (oxygen components) and having low sulfur content (e.g., below 40 ppm by weight). Condensates which consist predominant of kerosene or lower boiling components are another potential treating application. Recovered natural gas liquid components such as propane, butane, or natural gasoline are other potential treating applications. Condensates which consist predominantly of kerosene or lower boiling components may also be treated according to the instant invention to remove heteroatoms. Recovered natural gas liquid components such as propane, butane, or natural gasoline may also be treated to remove heteroatoms with appropriate modifications to existing structure to permit the handling of light end components.

Advantages of the Invention Over the Prior Art

The instant invention is an improvement over the prior art because, for among other reasons, the amount of air cooling required for regeneration of adsorbent in accordance with the instant invention is only a fraction of that normally required in conventional batch regeneration. Further, by more efficiently employing the heteroatom-free effluent hydrogen gas from the cool-down zone 194, the quantity of reactivating medium required to effect the reduction of heteroatom concentration to about 30 ppm is sharply reduced.

The process of the invention has the advantage of removing trace poisons and any moisture. Unlike conventional treating methods now used, the process produces no hazardous toxic liquid byproducts requiring disposal such as spent caustic and the product is inherently sodium free.

Only incremental hydrogen is consumed in the practice of the invention and occurs as a result of chemical conversion (about 10 SCF/barrel feed).

Apart from the utility and hydrogen savings afforded by the process of the invention, the capital investment for treating saturated liquid feed streams by the process of the invention is on the order of 1/7 that of conventional hydrotreating.

Because the upper stages in the absorber treat the most difficult heteroatoms with an absorbent containing the least heteroatom deposits and without the interference of the incoming heteroatoms already absorbed in the lower stages, wider boiling liquid mixtures can be economically treated by the process of invention. This enables the treatment of a C3 to full boiling range gasoline stream often available from the unsaturated gas plant of a refinery having a fluid cracking unit in a single unit so that when further separated into the propane-propene, butane-butene and gasoline products, the separated streams possess sufficiently low heteroatom content to meet the downstream processing requirements.

Subsequent distillation steps benefit in that the corrosive elements are no longer present.

Advantage of Novel Embodiment Shown for Illustrated Example Over Conventional Batch Adsorption The cost of the initial adsorbent inventory represents a major cost when considering adsorption. Conventional batch adsorption vessels for liquid treating typically are each sized for at least 8 hours onstream. With a minimum of two vessels, one onstream and one being regenerated, conventional batch adsorption requires 16 hours onstream residence time. In contrast, each adsorbent particle employed in the invention has a residence of about 2.7 hours in the adsorber. Residence of each adsorbent particle in the desorber vessel approximates about ¼th of the residence in the adsorber vessel. Thus, the invention significantly reduces the cost of the initial adsorbent inventory compared to conventional batch adsorption today.

Using the same hydrogen reactivating medium, the amount of reactivating medium required for conventional adsorption is significantly higher because of the necessity to heat up the vessel internals and walls, regenerate, and then cool down the equipment. In the illustrative example, the particles themselves continuously perform a required function in the desorber as well as in the adsorber.

As may be inferred, utilities required for the illustrated apparatus for treating the same feed with the same adsorbent are a fraction of that required for conventional batch adsorption.

As used in the invention, liquid fluid being treated has access to the entire surface of each adsorbent particle present in each expanded bed of the adsorber. Using smaller adsorbent particles than in conventional batch adsorption without pressure drops concerns, and the enhanced mass transfer from the bulk fluid to the adsorbent particles due to fluidization, provides a better approach to equilibria for the concentrations and adsorbent loads present in each stage in the illustrated example novel embodiment.

I claim:

1. A method of treating a liquid hydrocarbon stream useful as a precursor for transportation fuel and which contains an unacceptably high level of heteroatom compounds, in order to remove a significant proportion of the heteroatom compounds from the hydrocarbon stream, said method comprising the steps of:

providing a hydrocarbon stream containing an unacceptably high level of heteroatom compounds;

providing an adsorbent in the form of a finely divided particulate adsorbent stream, the adsorbent particles being characterized by the property of adsorbing said heteroatom compounds from said hydrocarbon stream;

providing an adsorption zone with an inlet and an outlet;

introducing said adsorbent stream into said adsorption zone and causing said adsorbent stream to flow therethrough;

introducing said hydrocarbon stream into said inlet, causing said hydrocarbon stream to flow therethrough for bringing said hydrocarbon stream into counter-current contact with said adsorbent stream in the form of a moving fluidized bed for adsorption of a portion of said heteroatom compounds to form a hydrocarbon stream exiting said adsorption zone outlet and a spent adsorbent stream exiting said adsorption zone in the proximity of said inlet;

providing a desorption zone and a cool-down zone for the regeneration of the spent adsorbent stream;

transferring said spent adsorbent from said adsorption zone into said regeneration zone by means of a hydrocarbon fluid carrier;

providing a plurality of hot hydrogen gas streams;

introducing said hot hydrogen gas streams into said desorption zone at a plurality of spaced regeneration stages along the length of the desorption zone, said hot hydrogen gas streams each being brought into cross-current contact with said downwardly flowing spent adsorbent stream for the transfer of heat from respective heated hydrogen gas streams to said spent adsorbent stream, the transfer of heat from the hydrogen gas stream to the adsorbent stream collectively being sufficient to raise the temperature of said spent adsorbent stream to a level to cause desorption of a portion of said heteroatom compounds from said adsorbent to form a hot regenerated adsorbent stream and a hydrogen and heteroatom gas stream;

causing said regenerated adsorbent stream to exit said desorption zone and enter said cool-down zone;

discharging said hydrogen and heteroatom stream from said desorption zone;

cooling said hot regenerated adsorbent stream in said cool-down zone to a temperature sufficiently low to permit subsequent adsorption of heteroatoms by the adsorbent; and recirculating said regenerated adsorbent stream from said cool-down zone to said adsorbent stream for introduction into said adsorption zone.

2. The method of treating a liquid hydrocarbon stream as set forth in claim 1, wherein is included the step of maintaining the temperature of the adsorbent stream and the hydrocarbon stream at about ambient temperature when said streams are brought into countercurrent contact in said adsorption zone.

3. The method of treating a liquid hydrocarbon stream as set forth in claim 1, wherein said adsorption zone includes six serially interconnected adsorption stages each having a lower inlet and an upper outlet, and presenting in said serial order thereof an initial adsorption stage and a final adsorption stage, said adsorption stages being located in disposition and interconnection in a manner such that the outlet of each stage is connected and communicates with the inlet of the next stage in the serial order thereof.

4. The method of treating a liquid hydrocarbon stream as set forth in claim 1, said adsorption stage reducing the heteroatom content of said hydrocarbon stream to less than 30 ppmw of sulfur.

5. The method of treating a liquid hydrocarbon stream as set forth in claim 1, said desorption zone including four serially interconnected regeneration stages, regeneration stage having an upper inlet and a lower outlet and presenting in said serial order thereof an initial regeneration stage and a final regeneration stage, each regeneration stage being located in disposition and interconnection in a manner such that the outlet of each stage is connected to and communicates with the inlet of the next adjacent stage in the serial order thereof.

6. The method of treating a liquid hydrocarbon stream as set forth in claim 1, said adsorption zone reducing the total heteroatom content of said hydrocarbon stream less than 0.5 ppmw.

7. The method of treating a liquid hydrocarbon stream as set forth in claim 1, said cool-down zone made up of a number of serially interconnected cool-down stages, each cool-down stage having an upper inlet and a lower outlet and presenting in said serial order thereof an initial cool-down stage and a final cool-down stage, each cool-down stage being located in disposition and interconnection in a manner such that the outlet of each cool-down stage is connected to and communicates with the inlet of the next adjacent cool-down stage in the serial order thereof.

8. The method of treating a liquid hydrocarbon stream as set forth in claim 7, wherein said cooling of hot regenerated adsorbent stream in said cool-down zone is to a temperature of about ambient temperature.

9. A method of treating a liquid hydrocarbon stream useful as a precursor for transportation fuel and which contains an unacceptably high level of heteroatom compounds, in order to remove a significant proportion of the heteroatom compounds from the hydrocarbon stream, said method comprising the steps of:

providing a hydrocarbon stream suitable for use as a motor fuel, said hydrocarbon stream containing a quantity of heteroatom compounds;

providing an adsorbent in the form of a finely divided particulate, fluidized bed adsorbent stream, the adsorbent particles being characterized by the property of adsorbing said heteroatom compounds from said hydrocarbon stream;

providing an adsorption zone made up of at least two serially interconnected adsorption stages each having a lower inlet and an upper outlet, and presenting in said serial order thereof an initial adsorption stage and a final adsorption stage, said adsorption stages being located in disposition and interconnection in a manner such that the outlet of each stage is connected to an communicates with the inlet of the next stage in the serial order thereof;

introducing said adsorbent stream into said adsorbent zone in the proximity into of said final adsorbent stage outlet and causing said adsorbent stream to thereafter flow downwardly in serial order through said adsorbent stages, from the outlet of a respective stage to the inlet of the stage next adjacent thereto;

introducing said hydrocarbon stream into said adsorbent zone initial stage inlet and thereafter causing said hydrocarbon steam to flow upwardly in serial order through said stages from the outlet of each of said stage to the inlet of the stage next adjacent thereto, said hydrocarbon stream being brought into counter-current contact with said adsorbent stream in said adsorption zone in the form of moving fluidized beds for adsorption of a portion of said heteroatom compounds by said adsorption stream to form a product hydrocarbon stream that exits the outlet of said final adsorption stage and a spent adsorption stream that exits said adsorption stage in the proximity of said initial adsorption stage inlet;

providing a regeneration zone and a cool-down zone, said regeneration zone made up of a number of serially interconnected regeneration stages, each having an upper inlet and a lower outlet and presenting in said serial order thereof an initial regeneration stage and a final regeneration stage, each regeneration stage being located in disposition and interconnection in a manner such that the outlet of each stage is connected to and communicates with the inlet of the next adjacent stage in the serial order thereof, said cool-down zone made up of a number of serially interconnected cool-down stages, each cool-down stage having an upper inlet and a lower outlet and presenting in said serial order thereof an initial cool-down stage and a final cool-down stage, each cool-down stage being located in disposition and interconnection in a manner such that the outlet of each cool-down stage is connected to and communicates with the inlet of the next adjacent cool-down stage in the serial order thereof, and said regeneration zone and said cool-down zone being located in disposition and interconnection in a manner such that the outlet of said final regeneration stage is connected to and communicates with the inlet of said initial cool-down stage;

introducing said spent adsorption stream into said initial regeneration stage upper inlet and causing said spent adsorption stream to flow downwardly into respective inlets of said regeneration stages and said cool-down stages;

introducing streams of heated hydrogen gas into said initial regeneration stage and into respective regeneration stages serially connected therewith, said heated hydrogen gas streams being brought into cross-current contact with said downward flowing spent adsorbent stream for the transfer of heat from said heated hydrogen streams to said downward flowing spent adsorbent stream, said heat transfer collectively being sufficient to raise the temperature of the spent adsorbent stream sufficiently high to cause the release of said heteroatom compounds from said spent adsorbent stream to form a hot regenerated adsorbent stream exiting said final regeneration stage outlet and a plurality of hydrogen and heteroatom gas streams exiting each regeneration stage;

introducing said hot regenerated adsorbent stream into said cool-down zone, causing said hot regenerated adsorbent stream to flow downwardly in serial order through corresponding cool-down stages, from the outlet of a respective stage to the inlet of the stage next adjacent thereto, introducing streams of cool hydrogen gas into said initial cool-down stage and into respective cool-down stages serially connected therewith and bringing said cool hydrogen gas streams into cross-current contact with said downward flowing hot regenerated adsorobent stream for the transfer of heat from the hot adsorbent stream to the cool hydrogen gas stream, said heat transfer collectively being sufficient to lower the temperature of the regenerated adsorbent stream below a temperature to permit adsorption of heteroatom compounds by the adsorbent; and recirculating said regenerated adsorbent to said adsorption zone.

10. A method of treating a liquid hydrocarbon stream which contains an unacceptably high level of heteroatom compounds, in order to remove a significant proportion of the heteroatom compounds from the hydrocarbon stream, said method comprising the steps of:

providing a hydrocarbon stream, said hydrocarbon stream containing an unacceptably high level of heteroatom compounds;

providing an adsorbent in the form of a finely divided particulate adsorbent stream, the adsorbent particles being operable to absorb said heteroatom compounds from said hydrocarbon stream;

providing an adsorption zone with an inlet and an outlet;

introducing said adsorbent stream into said adsorption zone and causing said adsorbent stream to flow therethrough;

introducing said hydrocarbon stream into said inlet, causing said hydrocarbon stream to flow therethrough for bringing said hydrocarbon stream into counter-current contact with said adsorbent stream in the form of a moving fluidized bed for adsorption of a portion of said heteroatom compounds to form a hydrocarbon stream exiting said adsorption zone outlet and a spent adsorbent stream exiting said adsorption zone in the proximity of said inlet;

providing a desorption zone and a cool-down zone for the regeneration of the spent adsorbent stream;

transferring said spent adsorbent in a slurry form from said adsorption zone into said regeneration zone by a hydrocarbon fluid carrier;

providing a hot reactivating medium in the form of a plurality of gas streams from the group consisting of hydrogen, nitrogen, methane, ethane, propane, and butane, and mixtures thereof;

introducing said hot gas streams into said desorption zone at a plurality of spaced regeneration stages along the length of the desorption zone, said hot gas streams each being brought into cross-current contact with said downwardly flowing spent adsorbent stream for the transfer of heat from respective gas streams to said spent adsorbent stream, the transfer of heat from the gas streams to the adsorbent stream collectively being sufficient to raise the temperature of said spent adsorbent stream to cause desorption of a portion of said heteroatom compounds from said adsorbent to form a hot regenerated adsorbent stream and a hydrogen and heteroatom gas stream;

causing said hot regenerated adsorbent stream to exit said desorption zone and enter said cool-down zone;

cooling said hot regenerated adsorbent stream in said cool-down zone to a temperature sufficiently low to permit subsequent adsorption of heteroatoms by the adsorbent; and recirculating by means of a hydrocarbon fluid carrier said regenerated adsorbent stream from said cool-down zone to said adsorption zone.

11. A method of treating a liquid hydrocarbon stream which contains heteroatom compounds, said method comprising the steps of:

providing a stream containing heteroatom compounds;

providing an adsorbent in the form of a finely divided particulate adsorbent stream, the adsorbent particles being of a size within the range of about 0.4 to about 1.6 mm and operable to absorb said heteroatom compounds from said stream;

providing a moving fluidized bed adsorption zone with an inlet and an outlet;

substantially continuously introducing said adsorbent stream into said adsorption zone and causing said adsorbent stream to flow therethrough;

substantially continuously introducing said liquid stream into said inlet, causing said liquid stream to flow therethrough for bringing said liquid stream into counter-current contact with said adsorbent stream in the form of a fluidized bed for adsorption of a portion of said heteroatom compounds to form a product liquid stream exiting said adsorption zone outlet and a spent adsorbent stream exiting said adsorption zone;

providing a desorption zone and a cool-down zone for the regeneration of the spent adsorbent stream;

transferring said spent adsorbent from said adsorption zone into said regeneration zone;

providing a hot reactivating medium in the form of a plurality of gas streams selected from the group consisting of hydrogen, nitrogen, methane, ethane, propane, and butane, and mixtures thereof;

introducing said hot gas streams into said desorption zone at a plurality of spaced regeneration stages along the length of the desorption zone, said hot gas streams being brought into cross-current contact with said downwardly flowing spent adsorbent stream for the transfer of heat from respective gas streams to said spent adsorbent stream, the transfer of heat from the gas streams to the adsorbent stream collectively being sufficient to raise the temperature of said spent adsorbent stream to cause desorption of a portion of said heteroatom compounds from said adsorbent to form a hot regenerated adsorbent stream and a hydrogen and heteroatom gas stream;

causing said hot regenerated adsorbent stream to exit said desorption zone and enter said cool-down zone;

causing said heteroatom gas stream to exit said desorption zone;

cooling said hot regenerated adsorbent stream in said cool-down zone to a temperature sufficiently low to permit subsequent adsorption of heteroatoms by the adsorbent; and recirculating by means of a liquid carrier said regenerated adsorbent stream from said cool-down zone to said adsorption zone, said liquid carrier formed from a portion of said product liquid stream.

* * * * *